US009824625B2

(12) United States Patent
Jeong et al.

(10) Patent No.: US 9,824,625 B2
(45) Date of Patent: Nov. 21, 2017

(54) DISPLAY DEVICE AND DRIVING METHOD THEREOF

(71) Applicant: LG DISPLAY CO., LTD., Seoul (KR)

(72) Inventors: Jaehyeong Jeong, Paju-si (KR); Seonggyun Kim, Gunpo-si (KR)

(73) Assignee: LG DISPLAY CO., LTD., Seoul (KR)

( * ) Notice: Subject to any disclaimer, the term of this patent is extended or adjusted under 35 U.S.C. 154(b) by 37 days.

(21) Appl. No.: 14/984,596

(22) Filed: Dec. 30, 2015

(65) Prior Publication Data

US 2017/0116914 A1 Apr. 27, 2017

(30) Foreign Application Priority Data

Oct. 21, 2015 (KR) ..... 10-2015-0146826

(51) Int. Cl.
*G09G 3/32* (2016.01)
*G09G 3/3225* (2016.01)

(52) U.S. Cl.
CPC ..... *G09G 3/3225* (2013.01); *G09G 2310/08* (2013.01)

(58) Field of Classification Search
CPC ..... G09G 3/3225; G09G 3/2003; G09G 2320/0626; G09G 3/2074; G09G 3/3607; G09G 3/3208; G09G 3/3406; G09G 3/3413; G09G 5/02; G09G 5/10
See application file for complete search history.

(56) References Cited

U.S. PATENT DOCUMENTS

| | | | | |
|---|---|---|---|---|
| 8,004,545 | B2 * | 8/2011 | Inuzuka | G09G 3/3413 345/102 |
| 8,896,509 | B2 * | 11/2014 | An | G09G 3/3648 345/690 |
| 9,171,526 | B2 * | 10/2015 | Inada | G09G 3/3406 |
| 9,349,333 | B2 * | 5/2016 | Ooga | G09G 3/3406 |
| 2006/0028495 | A1 * | 2/2006 | Phan | G09G 3/2003 345/694 |

* cited by examiner

*Primary Examiner* — Latanya Bibbins
*Assistant Examiner* — Sardis F Azongha
(74) *Attorney, Agent, or Firm* — Dentons US LLP

(57) ABSTRACT

Disclosed is a driving method of a display device that includes, for example, setting a luminance increase gain based on a chroma of an RGB data of an input image; modulating the RGB data of the input image based on the luminance increase gain to generate an RGB data of a first image; substituting a W data for common components of the RGB data of the first image and converting the RGB data of the first image to an RGBW data of a second image; and encoding the RGBW data of the second image into an RGBW data of a third image such that a number of bits of the RGBW data of the third image is less than a number of bits of the RGBW data of the second image.

14 Claims, 7 Drawing Sheets

DISPLAY DEVICE AND DRIVING METHOD THEREOF

This application claims the benefit of Korea Patent Application No. 10-2015-0146826 filed on Oct. 21, 2015, which is incorporated herein by reference for all purposes as if fully set forth herein.

BACKGROUND OF THE INVENTION

Field of the Invention

The present invention relates to a display device and a driving method thereof.

Discussion of the Related Art

An organic electroluminescent (EL) device used for an organic EL display is a spontaneous emission device having an emission layer formed between two electrodes. The organic EL device emits light in a manner in which electrons and holes are respectively injected into the emission layer from a cathode and an anode and combined to generate excitons. Light is emitted when an exciton drops from an excited state to a lower energy state.

In an organic EL display, when a scan signal, a data signal and power are supplied to sub-pixels arranged in a matrix, transistors included in selected sub-pixels are driven. Accordingly, the organic light-emitting diodes corresponding to the transistors emit light in response to an amount of current generated according to operations of the transistors, thereby displaying an image.

An organic EL display includes an organic light-emitting display device (hereinafter referred to as "RGBW OLED") which has a sub-pixel structure including red, green, blue and white sub-pixels in order to prevent decrease of luminance of pure colors and color deterioration while increasing optical efficiency.

When each piece of RGBW data is 10 bits, 40 bits (10 bits×RGBW (four sub-pixels)) are needed per pixel.

In a conventional RGBW OLED, a process of converting an RGB data into an RGBW OLED data is typically desired. In addition, a process of storing an RGBW data in a frame memory is typically desired for image control purposes such as PLC (Peak Luminance Control).

The conventional RGBW OLED assigns a minimum amount of RGB data to W data and minimizes the quantity of RGB data. Accordingly, the frame memory does not need to store 40 bits per pixel since one piece of data from among the RGBW data can be converted to "0".

The conventional RGBW OLED typically has 32 bits of data per pixel, which includes 2 bits (marking bits) for checking which data from among the input RGB data, which are not 40 bits, have been converted to "0", data that are not "0" from among the input RGB data, and W data. That is, the conventional RGBW OLED stores, in the frame memory, a 32-bit data corresponding to 10 bits×3 sub-pixels+2 bits=32 bits, that is, 30 bits corresponding to 3 sub-pixels to which three pieces of data are respectively supplied and 2 bits corresponding to the marking bits indicating sub-pixels to which "0" is supplied.

As described above, the conventional RGBW OLED typically needs to convert one of RGBW data values to "0" in order to store a 32-bit data in the frame memory, and thus, the conventional RGBW OLED does not simultaneously emit light corresponding to the RGBW data. As a result, the conventional RGBW OLED may not implement its maximum luminance.

SUMMARY OF THE INVENTION

Accordingly, the present invention is directed to a display device and a driving method thereof that substantially obviate one or more problems due to limitations and disadvantages of the related art.

An advantage of the present invention is to provide a display device with improved luminance and a driving method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a method for driving a display device may, for example, include setting a luminance increase gain based on a chroma of an RGB data of an input image; modulating the RGB data of the input image based on the luminance increase gain to generate an RGB data of a first image; substituting a W data for common components of the RGB data of the first image and converting the RGB data of the first image to an RGBW data of a second image; and encoding the RGBW data of the second image into an RGBW data of a third image such that a number of bits of the RGBW data of the third image is less than a number of bits of the RGBW data of the second image.

The RGBW data of the third image may include marking bit data for checking whether each of RGB data values selectively becomes "0" or the W data has a value of "K" (K being a natural number).

A range of controlling the luminance increase gain may be set to between 1 and 2 base on the chroma of a displayed image.

The method may further include decoding the stored RGBW data of the third image into the RGBW data of the second image on the basis of the marking bit data.

At least one of the RGB data values from which the common components have been subtracted may be "0".

In another aspect of the present invention, a display device may, for example, include a display panel; a timing controller including: an image luminance analyzer that upwardly modulates an RGB data of an input image on a basis of a luminance increase gain set based on a chroma of the RGB data of the input image to generate an RGB data of a first image, an image converter that substitutes a W data for common components of the RGB data of the first image and converts the RGB data of the first image to an RGBW data of a second image, the RGBW data including RGB data from which the common components have been subtracted, the RGB data having non-zero values, and an image encoder that encodes the RGBW data of the second image into an RGBW data of a third image such that a number of bits of the RGBW data of the third image is less than a number of bits of the RGBW data of the second image; and a frame memory that stores the encoded RGBW data of the third image.

The RGBW data of the third image may include marking bit data for checking whether each of RGB data values selectively becomes "0" or the W data has a value of "K" (K being a natural number).

A range of controlling the luminance increase gain may be set to between 1 and 2 base on the chroma of a displayed image.

The timing controller may include an image decoder for decoding the stored RGBW data of the third image into the RGBW data of the second image on the basis of the marking bit data.

At least one of the RGB data values from which the common components have been subtracted may be "0".

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings.

Figure 1:
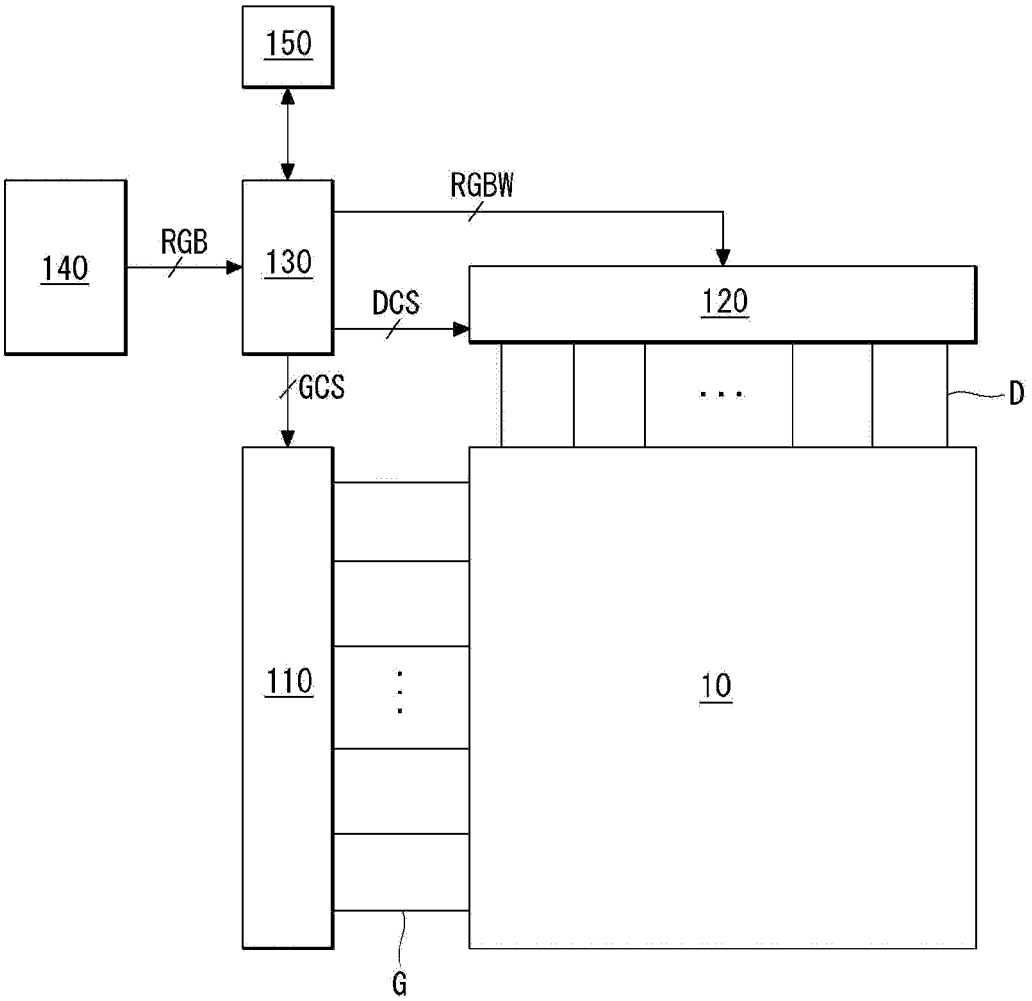
FIG. 1 is a block diagram of a display device according to an embodiment of the present invention.

FIG. 1 is a block diagram of a display device according to an embodiment of the present invention.

Referring to FIG. 1, the display device includes a display panel 10, a gate driving circuit 110, a data driving circuit 120, a timing controller 130 and a host system 140. The display panel may be implemented as a flat panel display such as a liquid crystal display (LCD), a field emission display (FED), a plasma display panel (PDP) and an organic light emitting diode (OLED). Although the display panel is implemented as an OLED in the following embodiment, the present invention is not limited thereto.

The display panel 10 displays an image under the control of the timing controller 130. The display panel 10 includes upper and lower substrates. A color filter array including a black matrix and a color filter is formed on the upper substrate of the display panel 10, and a pixel array in which cell regions defined by data lines D and scan lines G are arranged in a matrix is formed on the lower substrate. Each pixel of the pixel array of the display panel 10 includes at least one switching transistor, a driving transistor, an OLED element and at least one capacitor. Each pixel displays an image by controlling an amount of current flowing through the OLED element using the switching transistor and the driving transistor. The switching transistor and the driving transistor may be implemented as thin film transistors.

The display panel 10 displays an image according to a bottom emission type or a top emission type based on its pixel structure.

Figure 2:
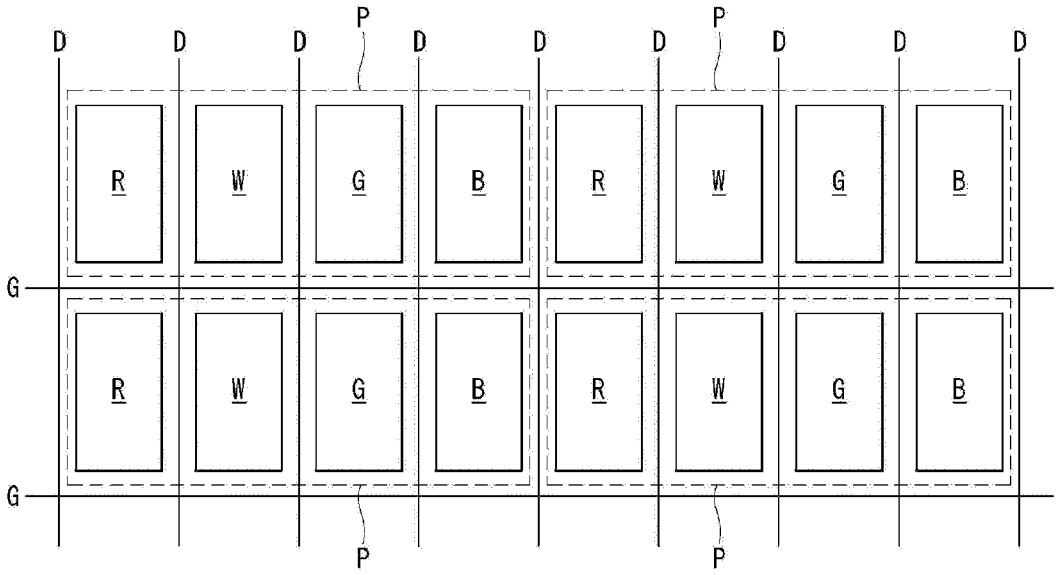
FIGS. 2 and 3 illustrate a part of pixels of a display device according to an embodiment of the present invention.
Figure 3:
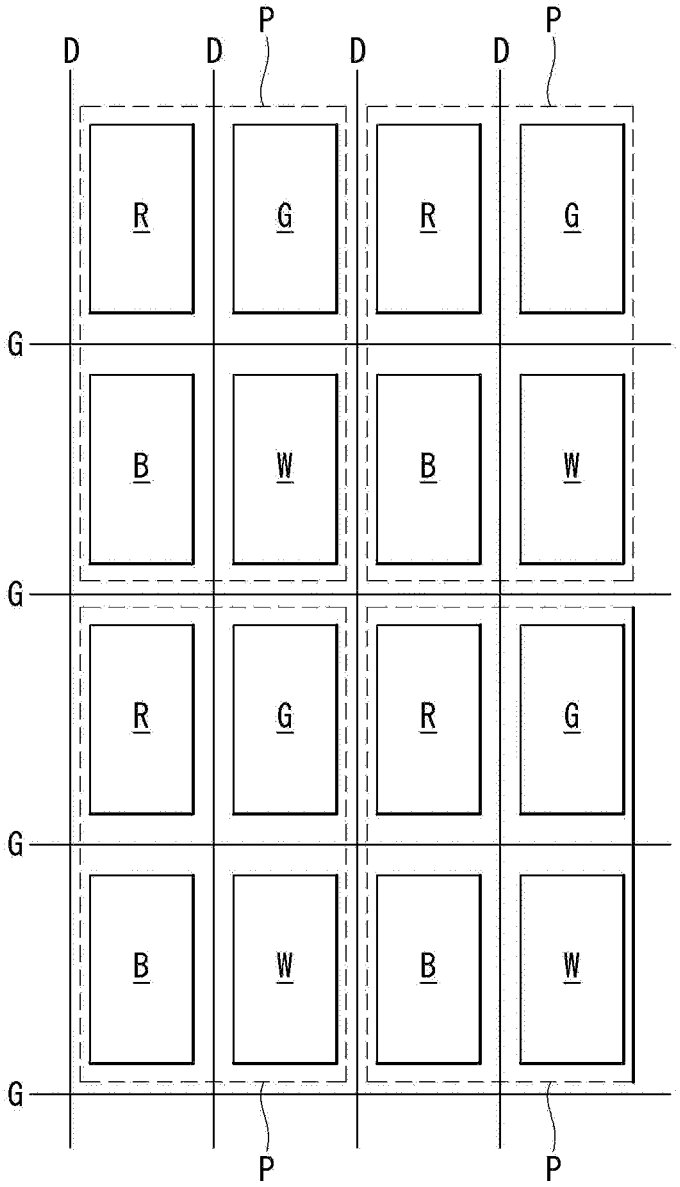

FIGS. 2 and 3 illustrate part of pixels of the display panel 10.

Referring to FIGS. 2 and 3, each pixel of the display panel 10 includes a red (hereinafter referred to as "R") sub-pixel, a green (G) sub-pixel, a blue (B) sub-pixel and a white (W) sub-pixel. The R sub-pixel includes an R color filter and emits a red light, the G sub-pixel includes a G color filter and emits a green light and the B sub-pixel includes a B color filter and emits a blue light. The W sub-pixel does not include a color filter and thus emits a white light. The R sub-pixel, the G sub-pixel, the B sub-pixel and the W sub-pixel may be sequentially arranged in a horizontal direction, as illustrated in FIG. 2. While FIG. 2 illustrates that the sub-pixels are arranged in the order of the R sub-pixel, the W sub-pixel, the G sub-pixel and the B sub-pixel, the present invention is not limited thereto.

Alternatively, the R sub-pixel, the G sub-pixel, the B sub-pixel and the W sub-pixel may be arranged in a rectangular form, as illustrated in FIG. 3. While FIG. 3 illustrates that the R sub-pixel and the G sub-pixel are arranged in a row and the B sub-pixel and the W sub-pixel are arranged in another row, the present invention is not limited thereto.

A driving circuit unit includes the data driving circuit 120 and the gate driving circuit 110.

The data driving circuit 120 includes a plurality of source drive ICs. The source drive ICs receive a digital RGBW data (RGBW) from the timing controller 130. The source drive ICs convert the digital RGBW video data (RGBW) into analog data voltages in response to a data timing control signal DCS from the timing controller 130 and supply the analog data voltages to the data lines D of the display panel 10. The source drive ICs can be coupled to the data lines D of the display panel 10 according to a COG (Chip On Glass) or TAB (Tape Automated Bonding) method.

The gate driving circuit 110 sequentially supplies a scan pulse synchronized with a data voltage to the scan lines G of the display panel 10 under the control of the timing controller 130. The gate driving circuit 110 includes a shift register for sequentially shifting and outputting a gate start pulse supplied from the timing controller 130 according to a gate shift clock signal, a level shifter for converting the output of the shift register into a swing width suitable for operation of the thin film transistors of the pixels, and an output buffer. The gate driving circuit 110 may be attached to the display panel according the TAB method or be formed on the lower substrate of the display panel 10 according to a GIP (Gate Drive IC in Panel) method. In the case of GIP, the level shifter may be mounted on a PCB (Printed Circuit Board), and the shift register may be formed on the lower substrate of the display panel 10.

The timing controller 130 receives an RGB data (RGB) from the host system 140 through an interface such as an LVDS (Low Voltage Differential Signaling) interface and a TMDS (Transition Minimized Differential Signaling) interface. The RGB data (RGB) transmitted from the host system 140 to the timing controller 130 includes an R data, a G data and a B data. The timing controller 130 converts the RGB data (RGB) to the RGBW data (RGBW) including an R data, a G data, a B data and a W data using the R data, the G data and the B data.

To do so, the timing controller 130 includes an image luminance analyzer, an image converter, an image encoder and an image decoder, converts the RGB data (RGB) to the RGBW data (RGBW) and outputs the RGBW data (RGBW) to the data driving circuit 120. Details thereof will be described later.

In addition, the timing controller 130 outputs a gate timing control signal GCS to the gate driving circuit 110 and outputs the data timing control signal DCS to the data driving circuit 120. Timing signals include a vertical synchronization signal, a horizontal synchronization signal, a data enable signal, a dot clock signal and the like. The gate timing control signal GCS includes a gate start pulse, a gate shift clock signal and a gate output enable signal. The gate start pulse signal controls timing of the first gate pulse. The gate shift clock signal is used to shift the gate start pulse. The gate output enable signal controls output timing of the gate driving circuit 110. The data timing control signal DCS includes a source start pulse, a source sampling clock signal, a source output enable signal and the like. The source start pulse controls data sampling start timing of the data driving circuit 120. The source sampling clock signal controls a sampling operation of the data driving circuit 120 on the basis of a rising or falling edge thereof. When the RGBW data (RGBW) input to the data driving circuit 120 is transmitted according to mini LVDS (Low Voltage Differential Signaling) interface specifications, the source start pulse and the source sampling clock signal may be omitted.

The host system 140 provides the RGB data (RGB) input from an external video source device to the timing controller 130 through the interface such as the LVDS interface and TMDS interface.

The frame memory 150 stores an encoded RGBW data of a third image. The frame memory 150 stores the encoded RGBW data of the third image for one frame in the frame memory 150 for one frame for image control purposes such as PLC (Peak Luminance Control).

Figure 4:
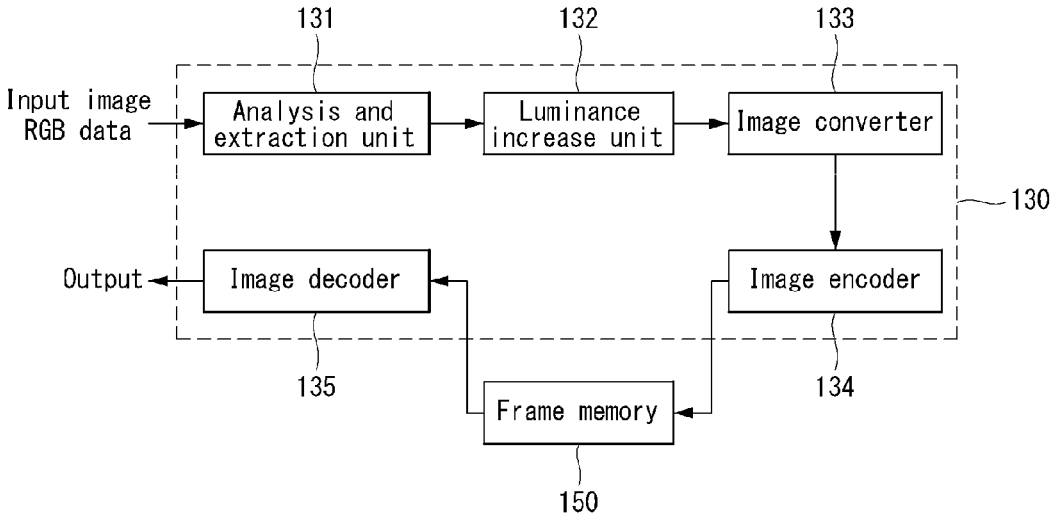
FIG. 4 is a block diagram of a timing controller according to an embodiment of the present invention.
Figure 5:
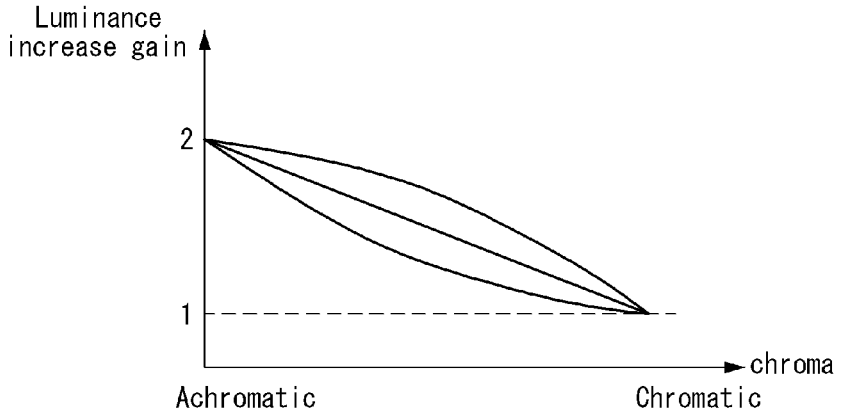
FIG. 5 is a graph showing a luminance increase gain base on chroma.

FIG. 4 is a block diagram of the timing controller according to an embodiment of the present invention, and FIG. 5 is a graph showing luminance increase gain base on chroma. A detailed description will be given of the timing controller 130 with reference to FIGS. 4 and 5.

Referring to FIG. 4, the timing controller 130 according to an embodiment of the present invention may include an image luminance analyzer 131, an image converter 132, an image encoder 133 and an image decoder 134.

The image luminance analyzer 131 upwardly modulates an RGB data of an input image on a basis of a luminance increase gain set based on a chroma of the RGB data of the input image to generate an RGB data of a first image. The image luminance analyzer 131 analyzes the chroma of the RGB data of the input image input from the host system 140 and sets the luminance increase gain according to the analyzed chroma of the RGB data of the input image.

For example, the image luminance analyzer 131 sets the luminance increase gain to "2" when the chroma of the RGB data of the input image is 0% corresponding to an achromatic color. The image luminance analyzer 131 sets the luminance increase gain to "1" when the chroma of the RGB data of the input image is 100% corresponding to a chromatic color. As shown in FIG. 5, the luminance increase gain can increase linearly or non-linearly as the chroma of the input image decreases.

A control range of the luminance increase gain may depend on display panel state, surrounding temperature and humidity, brightness and the like. Here, it may be desirable to set the luminance increase gain with respect to an extracted achromatic color to less than "2" since the luminance increase gain corresponds to luminance increase according to W data+(R data+G data+B data).

The image luminance analyzer 131 generates a first image data by upward modulating the RGB data of the input image on a basis of the set luminance increase gain. The image luminance analyzer 131 can increase the chroma of the RGB data (RGB) by respectively multiplying the R data, G data and B data by the luminance increase gain in a range of 1 to 2. The first image data is an RGB data (RGB) obtained by multiplying the RGB data (RGB) by the luminance increase gain.

As described above, the image luminance analyzer 131 is configured as one unit to analyze the chroma of the RGB data of the input image and sets the luminance increase gain according to the analyzed chroma of the RGB data of the input image, but the present invention is not limited thereto. For example, the image luminance analyzer 131 may be separated into a chroma analyzer (not shown) for analyzing the chroma of the RGB data of the input image and a luminance gain setting unit (not shown) for setting the luminance increase gain according to the analyzed chroma of the RGB data of the input image.

The image converter 132 substitutes a W data for common components of the RGB data of the first image so as to convert the RGB data of the first image to an RGBW data of a second image having non-zero RGB data values. That is, the image converter 132 converts the RGB data of the first image to the RGBW data of the second image by substituting the W data for the common components of the RGB data of the first image, which has been multiplied by the luminance increase gain.

The image converter 132 may subtract the common components of the RGB data of the first image from the RGB data by substituting the W data for the common components of the RGB data of the first image. Here, the W data preferably has the same luminance and color coordinates as those of the RGB data in the same quantity. When the luminance and color coordinates of the W data do not correspond to those of the RGB data, the image converter 132 may perform an additional calibration operation such as color coordinate calibration for matching the luminance and color coordinates of the W data with those of the RGB data in a process of converting the RGB data of the first image to the RGBW data of the second image. Detailed description thereof is omitted since the same is described in the reference (Publication No. 10-2009-0130045), which is incorporated herein by reference.

The image converter 132 can be activated in a default mode for displaying an RGBW data and deactivated in a test mode during engineering. When the image converter is deactivated, the W data has a data value of "0" all the time, and the RGB data is the same as the input of the image converter 132. Accordingly, each of the RGB data values can be "0" or greater than "0".

As described above, the image converter 132 supplies a text mode signal to the image decoder 134, which will be described below, under the control of the timing controller 140 when deactivated, and provides a default mode signal to the image decoder 134 when activated.

The image encoder 133 encodes the RGBW data of the second image to generate an RGBW data of a third image. The image encoder 133 encodes the RGBW data of the second image such that the number of bits of the RGBW data of the third image is smaller than the number of bits of the RGBW data of the second image. The image encoder 133 encodes an input image data such that the number of bits of the input image data is reduced. For example, if one of RGBW data values is 10 bits in which 40 bits (10 bits× RGBW (4 sub-pixels)) are desired per pixel, the image encoder 133 reduces 40 bits to 32 bits.

When the W data is substituted for the common components of RGB data, a maximum data value that can be substituted by the W data is "1023" since the W data is 10 bits. The image encoder 133 reduces the bits of the RGBW data in different manners depending on whether or not the common components of the RGB data do exceed the maximum data value "1023".

A description will be given of a case in which the common components of the RGB data of the input image, which has been multiplied by the luminance increase gain, do not exceed "1023".

At least one of the RGB data values becomes "0" when all the common components of the RGB data are substituted by the W data. The image encoder 133 recognizes a data having a data value greater than "0" from among the RGB data as a valid data along with the W data substituting for the common components, and encodes the same. The image encoder 133 encodes a data having a data value of "0" from among the RGB data through a marking bit data. The marking bits are 2 bits, and the data corresponding to "0" from among the RGB data can be recognized through the marking bits. For example, the R data is "0" when the marking bits are 01, the G data is "0" when the marking bits are 10, the B data is "0" when the marking bits are 11 and the W data is "0" when the marking bits are 00.

A description will be given of a case in which the common components of the RGB data of the input image, which has been multiplied by the luminance increase gain, exceed "1023".

The W data can substitute for the common components of the RGB data. Here, each piece of the RGB data is 10 bits and thus a maximum substitutable data value corresponding to the common components of the RGB data becomes "1023". Accordingly, the value of the W data is set to "1023".

Even when all the common components of the RGB data are substituted by the W data, all the RGB data values are greater than "0". Here, the W data is converted to a maximum substitutable data value, and thus, the value thereof is set to "1023". Since the value of the W data is set to "1023", the image encoder 133 can encode the W data using the marking bit data instead of a valid data.

Accordingly, the image encoder 133 can convert the RGBW data into a 32-bit data by encoding the data values, obtained by subtracting "1023" that is the W data value corresponding to the common components from the RGB data, into 30 bits and by applying the W data set to "1023" to 2 bits of the marking bit data. By doing so, the image encoder 133 encodes the 40-bit RGBW data of the second image to generate the 32-bit RGBW data of the third image.

The frame memory 150 stores the encoded RGBW data of the third image. The frame memory stores the 32-bit RGBW data of the third image for one frame. The timing controller 130 can store the RGBW data of the third image in the frame memory 150 for one frame for image control purposes such as PLC (Peak Luminance Control). Since the frame memory 150 stores the 32-bit RGBW data of the third image, a bandwidth of the frame memory can be reduced. Accordingly, power consumption associated with a high-speed drive can be decreased and, simultaneously, IC heat emission can be reduced.

The image decoder 134 decodes the RGBW data of the third image. The image decoder 134 decodes the 32-bit RGBW data of the third image, stored in the frame memory, into the 40-bit RGBW data of the second image. The image decoder 134 checks which one of the RGBW data values is "0" by analyzing the marking bits and decodes the remaining valid data which is not "0". Here, the image decoder 134 may select the W data value as "0" or "1023" through a test mode signal or a default mode signal supplied from the image converter 132 and restore the selected W data value. The image decoder 134 selects and restores the W data value "0" when the test mode signal is supplied thereto, and selects and restores the W data value "1023" when the default mode signal is supplied thereto.

Figure 6:
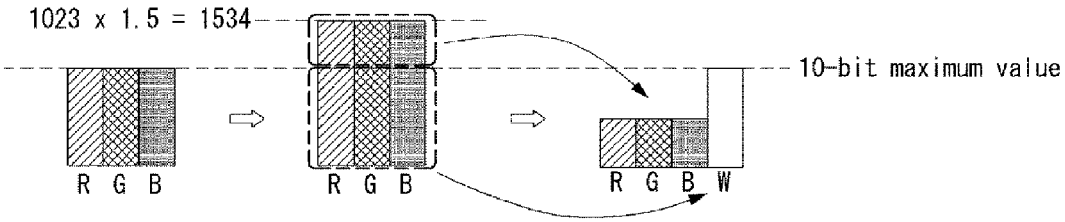
FIG. 6 illustrates a conversion operation of an image converter according to an embodiment of the present invention.

FIG. 6 illustrates a conversion operation of an image converter according to an embodiment of the present invention.

Referring to FIG. 6, the image converter 132 converts the RGB data of the first image to the RGBW data of the second image. The image converter 132 substitutes the W data for the common components of the RGB data, which has been multiplied by the luminance increase gain, so as to convert the RGB data to the RGBW data of the second image having non-zero data values.

When the luminance increase gain is 1.5 and each of the RGB data values is "1023", as illustrated in FIG. 6, the image converter 132 multiplies the R data by the luminance increase gain of 1.5 to convert the R data value to "1534", multiplies the G data by the luminance increase gain of 1.5 to convert the G data value to "1534" and multiplies the B data by the luminance increase gain of 1.5 to convert the B data value to "1534".

Here, the common components of the RGB data are "1534". The W data can substitute for all the common components of the RGB data. However, the W data can substitute for up to "1023" since the W data is 10 bits. Accordingly, the W data can substitute for up to "1023" from "1534" corresponding to the common components of the RGB data. Accordingly, "511", obtained by subtracting "1023" from "1534", becomes the data value of each piece of the RGB data and "1023" becomes the W data value.

As described above, the image converter 132 substitutes the W data for the common components of the RGB data, and thus, the RGBW data values can be greater than "0".

Figure 7:
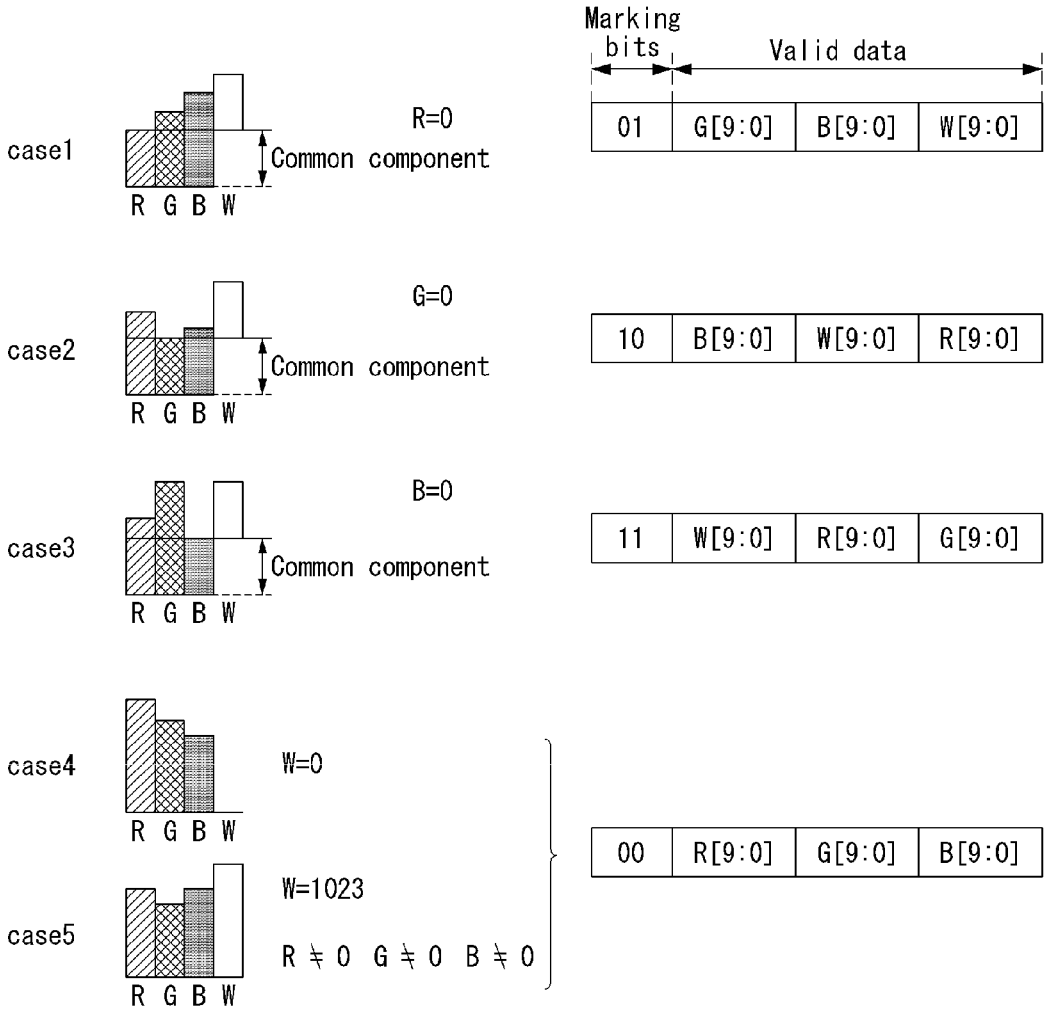
FIG. 7 illustrates an encoding operation of an image encoder according to an embodiment of the present invention.

FIG. 7 illustrates an encoding operation of an image encoder according to an embodiment of the present invention.

Referring to FIG. 7, the W data substitutes for the common components of the RGB data. Since all the common components of the RGB data are substituted by the W data, one of the RGB data values can be "0".

Case 1 corresponds to a case in which the R data is "0". Since the R data is "0", the GBW data becomes valid data. The image encoder 133 can encode the R data corresponding to "0" into marking bits of 01 and encode the GBW data corresponding to valid data into 30 bits.

Case 2 corresponds to a case in which the G data is "0". Since the G data is "0", the RBW data becomes valid data. The image encoder 133 can encode the G data corresponding to "0" into marking bits of 10 and encode the RBW data corresponding to valid data into 30 bits.

Case 3 corresponds to a case in which the B data is "0". Since the B data is "0", the RGW data becomes valid data. The image encoder 133 can encode the B data corresponding to "0" into marking bits of 11 and encode the RGW data corresponding to valid data into 30 bits.

Case 4 corresponds to a case in which the W data is "0". Since the W data is "0", the RGB data becomes valid data. The image encoder 133 can encode the W data corresponding to "0" into marking bits of 00 and encode the RGB data corresponding to valid data into 30 bits.

Case 5 corresponds to a case in which all the R data, G data, B data and W data are not "0". In this case, the common components of the RGB data exceed "1023" in the image converter 132, and thus the W data value is preset to "1023" through the image converter 132.

An operation of Case 5 is performed after conditions for Case 1 to Case 4 are checked. Accordingly, when the checking procedure reaches Case 5, it is possible to predict that the W data value is "1023". Therefore, the image encoder 133 can encode the W data value "1023" into marking bits of 00 and encode the RGB data corresponding to valid data into 30 bits. That is, when the marking bits are 00, the W data value can be encoded into "0" or "1023". An operation of decoding the W data value will be described later.

As described above, a driving method according to an embodiment of the present invention can encode an RGBW data into a 32-bit data even when all the RGB data values are not "0". Accordingly, a bandwidth of the frame memory 150 can be reduced. This enables driving operation in a narrow operation frequency band, to thereby reducing power consumption associated with a high-fast drive and IC heat emission.

Figure 8:
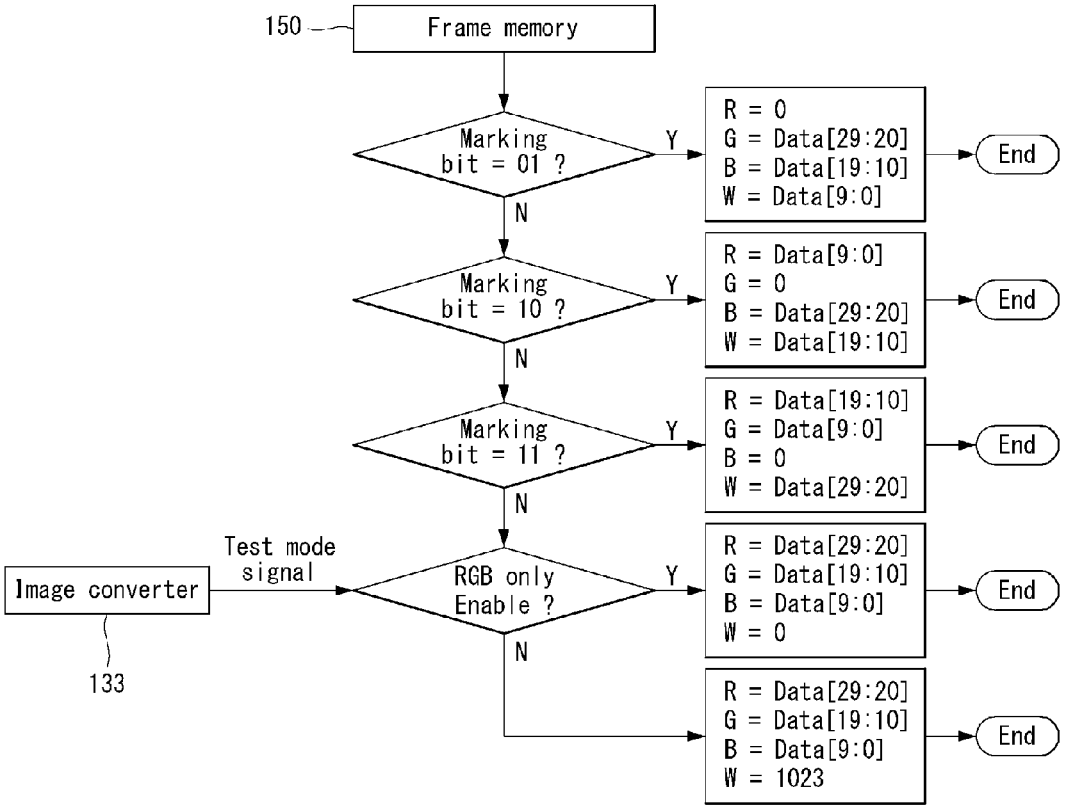
FIG. 8 illustrates a decoding operation of an image decoder according to an embodiment of the present invention.

FIG. 8 illustrates a decoding operation of an image decoder according to an embodiment of the present invention.

Referring to FIG. 8, the image decoder 134 decodes the RGBW data of the third image.

The image decoder 134 checks which one of the RGBW data values is "0" by sequentially analyzing the marking bits and decodes the remaining valid data which is not "0".

When the marking bits are 01, the R data is "0" and thus the image decoder 134 can decode the GBW data corresponding to valid data. When the marking bits are 10, the G data is "0" and thus the image decoder 134 can decode the RBW data corresponding to valid data. When the marking bits are 11, the B data is "0" and thus the image decoder 134 can decode the RGW data corresponding to valid data.

When the marking bits are 00, the W data value can be "0" or "1023". Here, the image decoder 134 determines the W data value as "0" when the test mode signal is supplied thereto and decodes the RGB data corresponding to the valid data. When the default mode signal is supplied to the image decoder 134, the image decoder 134 determines the W data value as "1023" and decodes the RGB data corresponding to the valid data along with the W data value "1023".

As described above, a driving method according to an embodiment of the present invention can reduce the frame memory bandwidth while simultaneously implementing 4 sub-pixels even when all the RGBW data values are not "0". This can improve luminance while reducing power consumption and IC heat emission.

Thus far, cases in which only one of the RGBW data values is "0" have been described, but the present invention is not limited thereto. A description will be given of a case in which one or more of the RGBW data values are "0".

When one or more of the RGBW data values are "0", only one piece of data is selected from a data having a data value of "0" using the marking bits, and the remaining data having the data value of "0" are selected as a valid data and encoded. The following operations are substantially the same as those described with reference to FIGS. 1 to 8.

As described above, a display device and driving method thereof according to embodiments of the present invention substitutes a W data for common components of an input RGB data, converts the W data value to a maximum data value "1023", encodes the W data value and decodes the encoded data value. However, the present invention is not limited thereto.

Since a R data, a G data, a B data and a W data have different efficiencies in an OLED element, it may be advantageous to represent a color W (white) through the W data rather than representing the color W by combining the RGB data. The OLED element can set a gamma voltage of the color W differently from gamma voltages of RGB in consideration of efficiency. Accordingly, the display device and method of driving the same according to embodiments of the present invention can set a maximum data value of the W data corresponding to the common components of the RGB data to a constant K (K being a natural number) which is not "1023".

It will be apparent to those skilled in the art that various modifications and variation can be made in the present invention without departing from the concepts and scope of the invention. Thus, it is intended that the present invention cover the modifications and variations of this invention provided they come within the scope of the appended claims and their equivalents.

What is claimed is:

1. A method for driving a display device, comprising: setting a luminance increase gain based on a chroma of an RGB data of an input image; modulating the RGB data of the input image based on the luminance increase gain to generate an RGB data of a first image; substituting a W data for common components of the RGB data of the first image and converting the RGB data of the first image to an RGBW data of a second image; and encoding the RGBW data of the second image into an RGBW data of a third image such that a number of bits of the RGBW data of the third image is less than a number of bits of the RGBW data of the second image, wherein, the RGBW data of the third image includes a marking bit data for checking whether the W data has a value of "K"(K being a natural number).

2. The method of claim 1, wherein the RGBW data of the second image includes an RGB data having non-zero values from which the common components have been subtracted.

3. The method of claim 2, wherein at least one of the RGB data values from which the common components have been subtracted is "0".

4. The method of claim 1, further comprising storing the RGBW data of the third image into a memory.

5. The method of claim 1, wherein the RGB data of the input image is upwardly modulated to generate the RGB data of the first image.

6. The method of claim 5, further comprising decoding the RGBW data of the third image into the RGBW data of the second image on a basis of the marking bit data.

7. The method of claim 1, wherein the RGBW data of the third image includes a marking bit data for checking whether each of RGB data values selectively becomes "0".

8. The method of claim 1, wherein a range of controlling the luminance increase gain is between 1 and 2 based on a chroma of a displayed image.

9. A display device, comprising: a display panel; a timing controller including: an image luminance analyzer that upwardly modulates an RGB data of an input image on a basis of a luminance increase gain set based on a chroma of the RGB data of the input image to generate an RGB data of a first image, an image converter that substitutes a W data for common components of the RGB data of the first image and converts the RGB data of the first image to an RGBW data of a second image, the RGBW data including RGB data from which the common components have been subtracted, the RGB data having non-zero values, and an image encoder that encodes the RGBW data of the second image into an RGBW data of a third image such that a number of bits of the RGBW data of the third image is less than a number of bits of the RGBW data of the second image; and a frame memory that stores the encoded RGBW data of the third image, wherein, the RGBW data of the third image includes a marking bit data for checking whether the W data has a value of "K" (K being a natural number).

10. The display device of claim 9, wherein the RGBW data of the third image includes marking bit data for checking whether each of RGB data values selectively becomes "0".

11. The display device of claim 10, wherein at least one of the RGB data values from which the common components have been subtracted is "0".

12. The display device of claim 9, wherein a range of controlling the luminance increase gain is set to between 1 and 2 based on the chroma of a displayed image.

13. The display device of claim 9, wherein the timing controller includes an image decoder for decoding the stored RGBW data of the third image into the RGBW data of the second image on the basis of the marking bit data.

14. A method for driving a display device, comprising: setting a luminance increase gain based on a chroma of an RGB data of an input image; modulating the RGB data of the input image based on the luminance increase gain to generate an RGB data of a first image; substituting a W data for a value of the RGB data of the first image and converting the RGB data of the first image to an RGBW data of a second image; and encoding the RGBW data of the second image into an RGBW data of a third image such that a number of bits of the RGBW data of the third image is less than a number of bits of the RGBW data of the second image; wherein the value of the RGB data of the first image is smaller value of either a common component of the RGB data of the first image or a predetermined value, wherein the predetermined value is less than or equal to the maximum data of a pixel, wherein, the RGBW data of the third image includes a marking bit data for checking whether the W data has a value of "K"(K being a natural number).

* * * * *